United States Patent [19]

Blaser

[11] 4,347,879

[45] Sep. 7, 1982

[54] BOTTLE NECK COUPLING DEVICE

[76] Inventor: Anton J. Blaser, 700 E. Mason St., Santa Barbara, Calif. 93103

[21] Appl. No.: 248,463

[22] Filed: Mar. 27, 1981

[51] Int. Cl.[3] ..... B15B 3/06

[52] U.S. Cl. ..... 141/364; 141/375; 211/74; 248/310

[58] Field of Search ..... 141/363–366, 141/375; 211/74; 248/172, 310, 316 D; 285/235

[56] References Cited

U.S. PATENT DOCUMENTS 3,709,429 1/1973 McKenzie et al. ..... 211/74 X 3,877,499 4/1975 Fluster ..... 141/364 X 4,217,941 8/1980 Catalano ..... 141/364 X

*Primary Examiner*—Frederick R. Schmidt

*Attorney, Agent, or Firm*—Ralph B. Pastoriza

[57] ABSTRACT

A device in the form of a collar has opposite end openings for receiving the neck end openings of two bottles such as ketchup bottles to hold them in axial alignment. With this arrangement, one bottle can have its ingredients transferred by gravity to the other bottle by standing the one bottle upside down on top of the second bottle. The collar device holds the bottle necks in proper alignment, so that the transfer of ingredients can take place.

1 Claim, 3 Drawing Figures

BOTTLE NECK COUPLING DEVICE

This invention relates generally to coupling devices and more particularly to a bottle neck coupling device for facilitating the transfer of ingredients from one bottle to another.

BACKGROUND OF THE INVENTION

Bottles containing liquid or semi-liquid ingredients such as salad dressing, syrup and ketchup bottles are oftentimes of an elongated shape with a fairly narrow neck. As a consequence, it is difficult to remove all of the ingredients from the bottle and in order to avoid waste, it has been a common practice to simply invert the almost finished bottle to an upside down position and carefully place it on the upstanding open neck end of a fresh bottle so that the remaining ingredients will drain by gravity into the fresh bottle or into another similar bottle, already containing the same ingredients. Problems with attempting to transfer the remaining ingredients from an almost empty bottle result largely from the difficulty in balancing the inverted bottle on top of the upright bottle with their necks in coaxial alignment in opposed relationship. More often than not, the upside down bottle will simply slip off from the right side up bottle and result in a mess.

The person or persons attempting the transfer can again try to balance one bottle on top of the other in its inverted position but in the case of ketchup bottles where the necks are of relatively small diameter, the process is at best clumsy and difficult and more often than not, a person loses patience and simply flings the almost empty bottle away.

BRIEF DESCRIPTION OF THE PRESENT INVENTION

The present invention solves the foregoing problem by providing a device in the form of a collar. This collar has opposite end openings of sufficient inside diameters to receive the neck end openings of two bottles such as ketchup bottles or syrup bottles and hold them in axial alignment. As a consequence, one bottle can have its ingredients transferred by gravity to the second bottle by standing the first bottle upside-down on top of the second bottle, the collar holding the bottles in their aligned position. A person effecting the transfer can then leave the area with confidence that the top bottle will not slip off from the supporting bottle. The bottles themselves may be left in the mounted positions with the collar in place overnight, so that by morning, the one bottle is sufficiently cleaned out that there is no waste in disposing of the same.

BRIEF DESCRIPTION OF THE DRAWINGS

A better understanding of this invention will be had by now referring to the accompanying drawings in which.

DETAILED DESCRIPTION OF THE INVENTION

Figure 1:
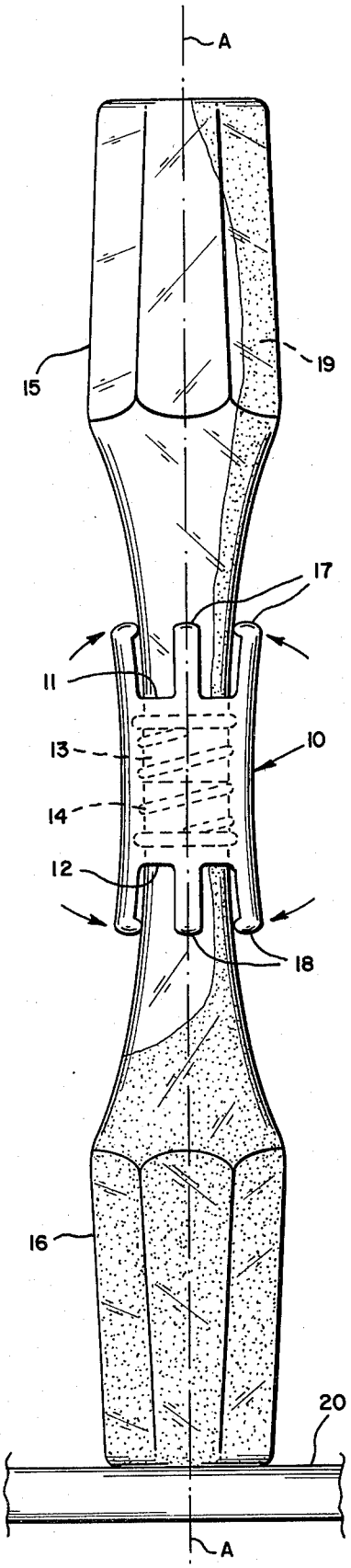
FIG. 1 is a side elevational view of two bottles being held with one turned upside down on top of the other by the device of the present invention so that ingredients in the one bottle can flow by gravity into the other bottle.

Referring first to FIG. 1, the device takes the form of an annular outer body or collar 10 having opposite end openings 11 and 12 of sufficient inside diameter to receive the neck end openings 13 and 14 of bottles 15 and 16 respectively. In the preferred embodiment illustrated in FIG. 1, there are also provided integrally formed flexible fingers 17 and 18 extending from opposite peripheral ends of the openings 11 and 12 and resiliently engaging the outside neck areas of the bottles 15 and 16 to aid in holding the bottles in axial alignment.

In FIG. 1, one of the bottles 15 is shown with remaining ingredients 19 flowing by gravity into the other bottle 16 which in turn is resting on a flat, level table surface 20.

Figure 2:
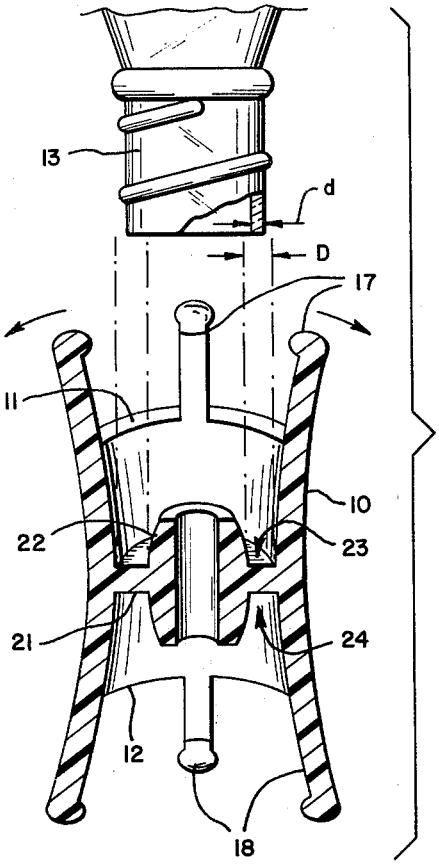
FIG. 2 is an enlarged cut-away perspective view of the device of FIG. 1 separated from the bottle necks.

Referring now to FIG. 2, further details of the coupling device 10 will be described. As shown, the preferred embodiment includes a central partition 21 and a tubular section 22 supported midway by the partition 21 within the annular body 10. The outside diameter of the opposite extending ends of the tubular section 22 is less than the inside diameter of the annular member or collar 10, so that there is defined an annulus designated by the arrow 23 therebetween. The width of this annulus is designated by the letter D in FIG. 2 and is made purposely slightly greater than the thickness "d" of the wall for the neck 13 of the one bottle. By this arrangement, bottles whose neck dimensions vary slightly can be accommodated by the single coupling device 10, the resiliency of the fingers 17 and 18 serving to result in engagement of the bottles by the fingers even though their sizes should vary.

It will be understood that the tube section 22 has its opposite ends received in the internal neck end openings of the bottles when the necks are received within the annulus 23, the collar or annular body 10 surrounding the outer or exterior portions of the neck. As a result, the opposing neck end openings of the bottles are held in axial alignment with each other internally as well as externally.

In the preferred embodiment described in FIG. 2 wherein there is provided the tube section 22, it will be understood that the ingredients will drain down through the central opening of the tube section.

Figure 3:
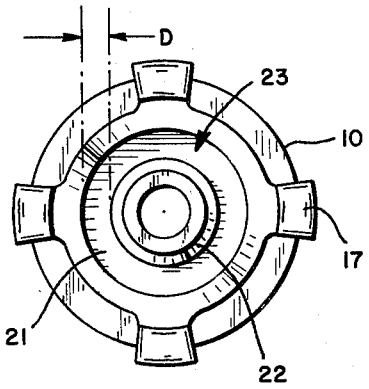
FIG. 3 is a top plan view looking into one end opening of the device of FIG. 1.

In the plan view of FIG. 3, the annulus 23 is more clearly illustrated and again the width of this annulus is designated by the letter D.

Preferably, the device is integrally formed in a single molding operation such as an injection molding operation. It can be comprised of any number of different types of plastic material so as to be unbreakable and yet provide the desired resiliency for the integrally formed fingers.

In operation, it will readily be understood that to transfer the ingredients of one bottle to another, it is only necessary to position the neck of the one bottle in one of the openings, such as the opening 11 of the annular collar 10 and the neck of the other bottle in the opposite opening 12 so that the necks are opposed to each other and held in axial alignment by the tube section 22 and the surrounding collar wall. The flexible fingers, as stated, are resilient and can move radially inwardly and outwardly as indicated by the arrows in FIG. 2 so as to engage the outer neck portions of the bottles respectively and aid in supporting them in the position illustrated in FIG. 1. After an appropriate length of time sufficient to permit the remaining ingredients in the one bottle 15 to be transferred by gravity to the bottle 16, the bottles are simply disengaged and the top bottle or one bottle 15 thrown away. The coupling device 10 can be removed from the other bottle and washed or cleaned in any desired manner for re-use.

In its broadest aspect, the collar could be formed from two bottle caps with their tops in opposed secured relationship and a hole formed therethrough. The opposite open ends of this "collar" would be internally threaded to thereby receive the threaded necks of the bottles and hold them in axial alignment during transfer, the internal threading already being provided from the bottle cap structure.

I claim:

1. A bottle neck coupling device for receiving in opposite ends the neck end openings of two bottles respectively and holding them in axial alignment so that one bottle can have its ingredients transferred to the second bottle by standing the one bottle upside down on top of the second bottle with their neck end openings held by said device, said device comprising, in combination:

an outer annular body having integrally formed flexible fingers extending from opposite peripheral ends and a central partition;

a tube section coaxially supported by said central partition at its mid portion so as to extend on either side of said partition within said body, said tube section having an outside diameter less than the inside diameter of said body to define an annulus therebetween on either side of the partition for receiving said neck ends of said bottles, the opposite ends of said tube section being received in the inside of the neck end openings and the annular body surrounding the outside of the neck end openings, said flexible fingers serving to hold the bottles in their mounted positions, said tube section holding the bottle neck end openings in coaxial alignment so that ingredients are transferred through said tube section by gravity.

* * * * *